US010850309B2

(12) United States Patent
Rizk

(10) Patent No.: US 10,850,309 B2
(45) Date of Patent: Dec. 1, 2020

(54) SONOTRODE APPARATUS AND DEVICE FOR ACOUSTIC LEVITATION, AND CONTROL DEVICE AND METHOD

(71) Applicant: Charles Rizk, Bochum (DE)

(72) Inventor: Charles Rizk, Bochum (DE)

( * ) Notice: Subject to any disclaimer, the term of this patent is extended or adjusted under 35 U.S.C. 154(b) by 468 days.

(21) Appl. No.: 15/736,428

(22) PCT Filed: Jun. 11, 2016

(86) PCT No.: PCT/DE2016/100267
§ 371 (c)(1),
(2) Date: Dec. 14, 2017

(87) PCT Pub. No.: WO2016/202326
PCT Pub. Date: Dec. 22, 2016

(65) Prior Publication Data

US 2018/0185878 A1 Jul. 5, 2018

(30) Foreign Application Priority Data

Jun. 14, 2015 (DE) ..... 10 2015 109 451

(51) Int. Cl.
*B06B 3/00* (2006.01)
*B06B 1/06* (2006.01)
(Continued)

(52) U.S. Cl.
CPC ..... *B06B 3/00* (2013.01); *B06B 1/0611* (2013.01); *G10K 11/26* (2013.01); *G10K 15/00* (2013.01)

(58) Field of Classification Search
CPC ..... B06B 3/00; B06B 1/0611; G10K 11/26; G10K 15/00
See application file for complete search history.

(56) References Cited

U.S. PATENT DOCUMENTS 3,464,102 A 9/1969 Soloff
4,074,152 A 2/1978 Asai et al.
(Continued)

FOREIGN PATENT DOCUMENTS

DE 1207123 12/1965
DE 2809820 9/1978
(Continued)

OTHER PUBLICATIONS

EP 2743919 Roland Radandt (Year: 2013).*
(Continued)

*Primary Examiner* — Bryan P Gordon

(57) ABSTRACT

Sonotrodes are used when examining substances on the basis of acoustic levitation. In order to obtain a reproducible measurement result or to extend the possible uses of devices of this kind, the respective sonotrode has to meet a whole range of requirements. Exact tuning of the frequency and clean interaction between the sonotrode and a frequency generator are particularly important. The present invention proposes that a sonic horn and a main body of the sonotrode are provided as different parts and, in this case, the sonic horn can be mounted on or in the main body in a specific manner, in particular for operation at low voltage in such a way that the amplitude or operating voltage remains below a comparatively low maximum low-voltage value, in particular 50 Vpp. The formation of heat can be prevented in this way. The present invention further relates to a control or production method for a sonotrode apparatus of this kind. In this case, it is respectively possible to extend the range of use and to improve the reproducibility or quality of the measurement results.

17 Claims, 4 Drawing Sheets

(51) Int. Cl.
*G10K 15/00* (2006.01)
*G10K 11/26* (2006.01)

(56) References Cited

U.S. PATENT DOCUMENTS

| | | | | |
|---|---|---|---|---|
| 4,520,656 | A | 6/1985 | Banuatz et al. | |
| 4,757,227 | A | 7/1988 | Danley et al. | |
| 4,962,330 | A | 10/1990 | Lierke | |
| 2002/0064341 | A1* | 5/2002 | Fauver | G02B 6/245 385/25 |
| 2003/0154790 | A1 | 8/2003 | Venturelli et al. | |
| 2004/0084995 | A1 | 5/2004 | Stegelmann | |
| 2008/0308404 | A1* | 12/2008 | Luotola | B01F 11/0266 204/157.15 |
| 2010/0010395 | A1* | 1/2010 | Gagnepain | B06B 1/0611 601/2 |
| 2010/0147466 | A1* | 6/2010 | Sans Marimon | B29C 66/81811 156/580.2 |
| 2012/0208002 | A1* | 8/2012 | Todd | B82Y 30/00 428/221 |
| 2014/0051035 | A1* | 2/2014 | Stoffel | A61N 7/00 433/173 |
| 2014/0238615 | A1 | 8/2014 | Coto | |

FOREIGN PATENT DOCUMENTS

| | | |
|---|---|---|
| DE | 102011015973 | 10/2012 |
| DE | 202012010508 | 11/2012 |
| EP | 2743919 | 10/2013 |
| JP | H05-262600 | 10/1993 |
| WO | WO 02/090222 | 11/2002 |
| WO | WO 2016/202326 | 12/2016 |

OTHER PUBLICATIONS

Mitteilung Gemäß Artikel 94(3) EPÜ [Communication Pursuant to Article 94(3) EPC] dated May 7, 2019 From the European Patent Office Re. Application No. 16750604.7 and Its Summary in English. (11 Pages).

Internationaler Recherchenbericht und Schriftlicher Bescheid der International Recherchenbehrde [International Search Report and the Written Opinion] dated Oct. 17, 2016 From the International Searching Authority Re. Application No. PCT/DE2016/100267 and Its Translation of Search Report Into English. (16 Pages).

Borosa et al. "Vergleich des Stofftransports von Hängenden und Akustisch LevitiertenWassertropfen in CO2", Chemie Ingenieur Technik, XP055308744, 86(5): 666-674, May 1, 2014. p. 669-670, Figs. 5, 4.

Tuckerman et al. "Schwebende Tröpfchen: Levitation in Ultraschallfeldern", Physik in Unserer Zeit, XP055308749, 32(2): 69-75, Mar. 9, 2001. Abschnitt: "Aufbau eines Ultraschallvibrators", Fig.4.

Internationaler Vorläufiger Bericht über die Patentierbarkeit [International Preliminary Report on Patentability] dated Aug. 9, 2017 From the Internationalen Vorläufigen Prüfung Beauftragten Behörde [International Preliminary Examining Authority] Re. Application No. PCT/DE2016/100267 and Its Translation Into English. (18 Pages).

Internationaler Vorläufiger Bericht über die Patentierbarkeit [International Preliminary Report on Patentability] dated Apr. 18, 2017 From the Internationalen Vorläufigen Prüfung Beauftragten Behörde [International Preliminary Examining Authority] Re. Application No. PCT/DE2016/100267 and Its Summary in English. (8 Pages).

Prüfungsantrag [Examination Report] dated Apr. 1, 2016 From the Deutsches Patent- und Markenamt Re. Application No. 102015109451.7 and Its Summary in English. (6 Pages).

Prüfungsantrag [Examination Report] dated Apr. 15, 2016 From the Deutsches Patent- und Markenamt Re. Application No. 102015109451.7 and Its Summary in English. (6 Pages).

Prüfungsantrag [Examination Report] dated Apr. 20, 2016 From the Deutsches Patent- und Markenamt Re. Application No. 102015109451. 7. (2 Pages).

Borosa et al. "Apparatur zur Untersuchung der Stofftransportmechanismen an Schwebenden Tropfen Unter Erhöhten Drücken [Apparatus to Study the Mass Transport Mechanisms of Levitated Droplets at Alevated Pressures]", Chemie Ingenieur Technik, 84(1-2): 145-148, Jan. 2012.

Examination Report dated Jul. 17, 2020 From the Australian Government, IP Australia Re. Application No. 2016278510. (4 Pages).

* cited by examiner

SONOTRODE APPARATUS AND DEVICE FOR ACOUSTIC LEVITATION, AND CONTROL DEVICE AND METHOD

RELATED APPLICATIONS

This application is a National Phase of PCT Patent Application No. PCT/DE2016/100267 having International filing date of Jun. 11, 2016, which claims the benefit of priority of German Patent Application No. 10 2015 109 451.7 filed on Jun. 14, 2015. The contents of the above applications are all incorporated by reference as if fully set forth herein in their entirety.

FIELD AND BACKGROUND OF THE INVENTION

The present invention relates to a sonotrode or sonotrode device, respectively, and an apparatus with such a sonotrode device, in particular for tests by means of acoustic levitation, as well as a control device or a control method, respectively, for controlling the sonotrode/sonotrode device or the apparatus, respectively. In particular, the invention relates to a sonotrode device at least having the following components: a base body, a sonic horn fastened to the base body for emitting sonic waves. Not least, the present invention also relates to the use of a sonotrode/sonotrode device adjusted according to the invention as well as a production method for the sonotrode device.

A sonotrode can be seen as a kind of loud speaker which is arranged between a frequency generator, amplifier and, for example, a reflector or a second sonotrode. The sonotrode has a very specific natural frequency that depends on a plurality of factors which cannot be influenced altogether most of the time, for example, the alloy constituents of the material, or geometric production tolerances. The sonotrode is usually operated in the range of the natural frequency, thus at resonance. A standing acoustic wave can be generated between the sonotrode and the reflector.

Sonotrodes can in particular comprise the following components: a base body with a specific geometry and mass; a sonic horn for emitting sonic waves in the direction of a reflector, wherein the sonic horn can be provided by means of the base body. It is known to provide the sonic horn permanently on the base body. Further, an electrically contactable unit for forwarding sound can be provided, in particular with at least one oscillating element/oscillation exciter preferably of ceramics, which is connected to the base body or is integrated in the base body. Measures can be taken on the unit for forwarding sound or also on the base body to adjust the natural frequency of the sonotrode.

Patent document DE 199 56 336 B4 describes an encapsulated device and a method for acoustic levitation, with which the mass density of the fluid to be examined is set greater than the mass density of a carrier fluid. As a result, the fluid to be examined is to be held in the range of the standing wave in an adequate manner and is to be examined over a longer time. To ensure adequate temperatures, tempering means are provided. A frequency generator, a sound converter and a reflection apparatus which is described as a unit of three components, are provided for establishing the wave field. The three components are arranged within an encapsulation/housing in which the wave field is also generated. The sound converter is arranged directly at the frequency generator. The structure of the sound converter is not described in detail.

For the precise setting of the sonotrode or for a proper testing or reproducible results, respectively, it is decisive to adjust the natural frequency of the sonotrode as precisely as possible. Depending on the type or structure of the sonotrode, different measures can be taken, or parameters be changed. Some difficulties when using sonotrodes for acoustic levitation are briefly mentioned in the following. The present invention allows an improvement regarding these problems, be it exclusively with respect to an individual problem or also with respect to all of these problems.

Often, sonotrodes cannot be set easily. Attuning or finely tuning with regard to manufacturing tolerances or certain cases of use or environmental conditions often is not possible or only with high effort. However, this would be desirable as already the smallest variation, e.g. a small burr on a contact point, can influence the natural frequency of the sonotrode.

Most of the time, sonotrodes can be operated no longer than several hours as they easily overheat and thus need to cool down again or must be cooled down actively using cooling power. In particular, at high voltages, e.g. in the range of at least 300V, heating or noises occur, and a cooling and nevertheless prompt turning-off of the sonotrode becomes necessary.

U.S. Pat. No. 4,757,227 A describes a device with a plate of flexible material which is mounted to a shaft. Patent specification DE 1207123 A describes a device, in which an end piece is mounted to a base body in a planer manner. WO 02/090222 A1 describes a holding element with a suction bore, in particular in conjunction with fixing elements. US 2003/0154790 A1 indicates a temperature dependence of the natural frequency of a sonotrode. DE 102011015973 A1 describes different geometries of a sound-emitting end piece. It has shown that the described arrangements can be improved, in particular regarding an attuning of a natural frequency and regarding obtainable precision.

The object is to provide a sonotrode or an apparatus for examining substances, in particular fluids, by means of acoustic levitation, thereby allowing to facilitate examinations or improving the precision or reproducibility of the examinations can be improved. The object can also be seen as to expand the range of application/range of use of the sonotrode or the apparatus, i.e. to provide an apparatus which can be used as universally as possible for a plurality of different examinations or substances. In addition, the object is to provide a device which can be adjusted in a particularly precise manner, and by means of which a particularly broad range of application can be developed. Another object is to configure the sonotrode or the apparatus such that examinations/measurements can reproducibly be carried out in an easy manner or on a high professional level. Not least, the object is to provide a method for at least some of these aspects.

SUMMARY OF THE INVENTION

At least one of these objects is achieved by means of a sonotrode device according to claim 1 and an apparatus or a mounting kit according to the respective dependent claim of the device as well as through a method according to the dependent claim of the method. The features of the exemplary embodiments described in the following can be combined with one another as long as this is not explicitly denied.

A sonotrode device is provided for providing sonic waves for examinations by means of acoustic levitation, and comprises: a base body, a sonic horn for radiating/emitting sonic waves, in particular in the direction of a reflector. According to the invention, it is proposed that the sonic horn and the base body are different parts and the sonic horn is mountable in a fastening point in an installation depth on or in the base body. In other words: base body and sonic horn together form at least two parts, in particular two directly-connected parts, and can be provided as a type of mounting kit. As a result, a respective sonotrode can individually be adjusted, in particular the natural frequency thereof. It has proved that even a material removal through sandpaper may have an effect on the natural frequency. In particular in a sonotrode device according to the invention, which can be operated at low voltage or with a low voltage source, the precise attuning of the natural frequency is highly beneficial. The user or service provider or vendor of the sonotrode device can perform fine attuning even with slight manufacturing tolerances to be accepted. The sonotrode device or the final product can be optimized substantially independent of the quality of intermediate products by suppliers. Each sonotrode can also be optimized in view of a specific range of application. The adjusting or optimizing of the properties of the sonotrode can be facilitated.

Usually, through measures on the base body, attuning could be effected or properties of the sonotrode could be influenced thus far. As the sonic horn is now realized separately, precise attuning or fine tuning can be effected as well at the connecting point or fastening point between the base body and the sonic horn, in particular as deep in a pouch as possible. For example, the sonic horn can be screwed into the base body at a specific torque, or the absolute length of the sonic horn or the absolute mass thereof can be changed minimally. Optionally, another sonic horn can be used, in particular without having to replace the base body. The selection of the material of the sonic horn can also be effected irrespective of the material of the base body.

Although an exact geometry does not necessarily have to be observed, the separate sonic horn allows to vary the geometry and thus also the sound characteristics of the sonotrode device at least to a small extent, so that the sonotrode device is easily optimizable.

Precisely because the sonic horn is realized as a compact, simple and preferably as an integral component, precise attuning by means of the sonic horn is particularly promising. Furthermore, it has shown that measures are particularly effective in a region in which the sound is emitted.

The installation depth on or in the base body requires replacing the fastening point toward the inside. Substantially, two variants need to be differentiated: The installation depth is measured from a front face of the base body facing the sound reflector (the fastening point is further spaced from the reflector), or from a free end of a shaft of the sonic horn to the fastening point in the shaft (the fastening point is approached to the reflector). In the latter variant, the base body comprises, for example, a stud. Both measures can have the same effect: acoustic and/or thermal decoupling from the base body, and a more effective or more sensitive attuning of the sonic horn, in particular of the natural frequency.

The sonic horn does not necessarily have to be mountable in a reversible manner. A demounting is not necessarily required, though it eases e.g., a replacement of the sonic horn. But the sonic horn can be mountable in a reversible manner, i.e., the connection location or fastening point can be configured both for repeated (de-)mounting as well as for repeated later attuning, for example, re-adjustment of a screw-in torque.

The fastening point can include one or multiple fastening points. The fastening point can extend along a section in the axial direction (wave expansion direction), be it along a shaft of the sonic horn, be it along a pouch or coupling in the base body. The fastening point can be provided in individual circumferential sections and/or circumferentially.

A separate sonic horn further allows a better or more direct or attunable coupling to a means for forwarding sound. A connection mechanism or a coupling between these components can be designed individually.

As the sonic horn is formed separately, a heat generation at the sonotrode device can be reduced as well. It has shown that a low input voltage and an optimized geometry of the sonotrode device are particular effective measures for reducing the generation of heat. A separate sonic horn provides advantages here. It has shown that a shaft of the sonic horn can serve for decoupling the sound characteristics of the sonic horn from those of the base body which allows a more targeted attuning, in particular in a manner as to be possibly independent of the base body.

In a second step, a control program or a control device can optionally also be adjusted to the sonotrode device optimized by means of the coupling/connecting point between base body and sonic horn. The adjustment of the software can hereby also consider geometric adjustments. Here, the control device can in particular control a frequency generator or amplifier depending on a certain natural frequency of the sonotrode/sonotrode device. By being able to influence the natural frequency of the sonotrode device by means of the arrangement of the sonic horn, it is possible to adjust the control device, the sonotrode device as well as the frequency generator to one another in a particular precise manner. The control program can thereby be adjusted for example, with respect to the natural frequency, in particular with respect to the tightening torque of the sonic horn, a high pressure screwing or a cover or flange of the sonotrode device, or with respect to pressure, temperature or also with respect to external environmental influences on the sonotrode device. These parameters influence the natural frequency.

Here, the control device can also be in communication with an amplifier of the apparatus. The amplifier can be operated at a basic frequency in the range of, for example, 50 kHz.

It has thereby been shown that not only fluids but also crystals, particles or other substances can be examined in an adequate manner by means of the sonotrode device according to the invention. Here, the selection of the fluids can be very broad. For example, gas bubbles in a liquid can also be examined.

It has also shown that the sonotrode device according to the invention is suitable for particularly long-lasting examinations, for example, multiple hours or even days, without the need to be switched off. Here, the distinct sonic horn, in particular in conjunction with a pouch/cavity at the coupling location provides an advantageous effect. It has shown that a pouch provides the advantage that oscillation cannot as easily be transmitted to further components, in particular a housing. As a result, the forwarding of oscillation to the sonic horn can be made more efficient, in particular in high pressure applications. Also through the geometry of the base body or through the material selection, the maximum operating time can be influenced, or the cooling effort reduced. According to variants of the invention, a cooling is not necessary at all.

The invention also relates to high pressure applications, e.g. in the range of up to 200 bar or 1000 bar. Also, higher pressures can be achieved. A certain high pressure can be realized, e.g. by means of sealings (in particular O rings) and/or magnetic couplings. The high pressure can be built by means of CO2 gas, for example. The invention also relates to a particularly broad temperature range, e.g. from −20° C. to far over 180° C., e.g. to 400° C., or even far beyond 400° C. The sonotrode device is configured to be employed in a broad pressure and/or temperature spectrum. The sonotrode device can cover, for example a temperature spectrum from −20° C. to 180° C. or 250° C.

Preferably, waves above a frequency of 20 kHz up into the ultra sound range are used, e.g. any frequency above 20 kHz, e.g. in the range of 40 kHz (base frequency).

Another property of the waves is the amplitude. The amplitude can be indicated in the unit [VPP], which stands for the voltage difference between two voltage peaks ("peak-to-peak"). The amplitude can, e.g. be in the range of 50 Vpp (base voltage) corresponding to an initial voltage of the frequency generator of, e.g. 10 Vpp which is increased by a factor of, for example 5 through the amplifier. Here, the frequency generator can comprise a low-voltage source.

Here, as a sonic horn, a part or element, respectively, or a component section is to be understood, from which sound waves are initially emitted, i.e. which issues sound waves to the environment, in particular into an examination chamber. The sonic horn can also be described as a sound converter or converter plate.

As already mentioned in DE 199 56 336 B4, a sonic horn may have different geometries. According to the invention, the sonic horn comprises preferably the geometry of a cone or is cone-shaped at one end. At the other end, the sonic horn can be formed rod-shaped or in the type of a shaft, in particular formed as a round rod so that it can also be referred to as "pin". Between the one end and the other end, a tapering or a sliding continuous transition or run, respectively extension, can be provided. In other words: the diameter of the sonic horn can progressively increase toward the cone-shaped end. The sonic horn can be structured or shaped in the type of a valve having a valve plate and arranged upstream the injection chamber in a combustion engine. Here, the plate-shaped end has the function of emitting or reflecting sound. According to one variant, the sonic horn can comprise a shoulder on the shaft on which shoulder the sonic horn can be braced at the front face of the base body. The shaft advantageously comprises the same diameter at least in sections. The shaft advantageously comprises a centering. The sonic horn does not necessarily need to include a particularly long shaft, but can also essentially be formed through a converter plate or a plate which, e.g. comprises only a relatively short pin or extension. Depending on the field of application, it has shown that a relatively long shaft, for example with a length at least corresponding to the diameter of the plate, can facilitate the attuning. This is because a relatively long shaft allows to displace the fixation point of the sonic horn to the inside of the base body or also away from a front face of the base body in the direction of a reflector. A relatively long shaft offers considerable options in particular in conjunction with a pouch in the base body or in the shaft to precisely perform the natural frequency coordination, namely largely independent of a certain design of the base body. According to one variant, the shaft is longer than the width of the base body.

In connection with the sonotrode according to the invention, which is advantageously used at low voltages below 100V, preferably even below an amplitude of 50 Vpp, attuning the natural frequency as exact as possible is particularly expedient. As a result, a highly efficient arrangement can be provided, which emits only few noises if at all, preferably operates noiseless, and which hardly heats up, requires no cooling, and can be used continuously over a long operating time. Compared to the so-far conventional high voltages, in particular over 300 V, numerous advantages can be achieved through precise calibration of the natural frequency in conjunction with a low voltage.

A low voltage or a small amplitude below 50 Vpp also allows contact by a person with no risk. The device can be touched. Also, no significant energy input is effected on a sample to be examined. This offers new fields of application.

Preferably, the sonic horn is of titanium (material), in particular to allow use in a broad spectrum in view of temperature and pressure.

Attuning can be effected in a relatively simple manner if the sonic horn is integral, respectively formed in one piece, and comprises a relatively long shaft which is arranged in a pouch of the base body. The sonic horn can also consist of multiple parts, this however, can make attuning more difficult or generate further variables which need to be understood, first of all. For example, a plate can be configured separately from the shaft which can offer further options in view of adjustment or also advantages when mounting. The shaft can also be formed on the base body, e.g. integral/in one piece with the base body, and the separate part of the sonic horn then includes, e.g. only the plate or the plate and a short appendix in the type of a shaft. This can have advantages when mounting or also when arranging the sonotrode outside of an examination chamber, in particular outside a high-pressure view cell or outside a high temperature examination chamber. In other words: the exact embodiment of the sonic horn needs to be specified case by case. However, it is important that the intersection between base body and shaft can be adjusted in a precise manner. This is because it has shown that attuning between base body and shaft is particularly influential or effective. A shaft integrally connected to the base body displaces the location of attuning further toward the plate, what is possibly is less effective. Nevertheless, this arrangement also can be advantageous in an individual case.

According to one exemplary embodiment, the sonic horn comprises a shaft with coupling means which is mountable in the installation depth in the fastening point on or in the base body. This facilitates a decoupling.

According to one exemplary embodiment, a/the shaft of the sonic horn comprises a contact surface at the front face side which is formed corresponding to a contact surface on the base body. The contact surface at the front face side can also be formed in a pouch of the shaft. Corresponding contact surfaces facilitate the transmission of structure-borne sound in a definable manner. In the fastening point, corresponding contact surfaces can be brought into abutment with one another, in particular with pre-definable biasing force or contact force (pressure or surface pressing).

The sonic horn can be formed in one piece, in particular cone-shaped with a plate and a shaft. The sonic horn can be rigid/inflexible, in particular completely of metal or of at least one metallic material.

According to one exemplary embodiment, the sonotrode device comprises a high-pressure resistant housing and is configured for operation at high pressure over 200 bar, in particular up to 1000 bar. Furthermore, the sonotrode device can be configured for providing the sound waves at low voltage, in particular such that the amplitude of emitted sound waves is kept below 50 Vpp. The sonotrode device can comprise a low voltage source.

According to one exemplary embodiment, the sonic horn is centered on the base body, in particular on a shaft of the sonic horn. This allows a very precise alignment of the sonic horn, even with a relatively long shaft or a relatively great installation depth. Preferably, the centering is provided in the pouch. The centering can be provided by means of the coupling means.

According to one exemplary embodiment, the fastening point is configured for form-fit and/or force-fit fastening, in particular for reversible fastening. This allows different variants and offers a high flexibility when attuning. The sonic horn can, e.g. be screwed to the base body with a predefined torque. To that end, it is advantageous if a working surface for a tool is provided on the sonic horn, in particular wrench flats for an open-end wrench, preferably on a conical section of the plate. Here, the fastening point advantageously includes also a fitting and/or a centering. Both measures can allow a particularly precise alignment of the sonic horn.

According to an exemplary embodiment, the base body comprises coupling means including a cavity or pouch for fastening/coupling the sonic horn in the fastening point, in particular including a cavity or pouch, wherein the coupling means are preferably form-fit and/or force-fit, for example comprise a thread, in particular a female thread. Alternatively, or additionally, the sonic horn can comprise coupling means, in particular a male thread configured corresponding to the female thread. The thread or a comparable mechanical connection of the coupling means can, e.g. be provided in a blind hole. The fastening point can be defined by the hole.

The pouch can have different geometries, in particular depending on the geometry of the shaft. For example, an outer shell surface of the shaft extends in parallel to the inner shell surface of the pouch, at least in sections. The inner shell surface of the pouch can be cylindric, for example. The pouch can be deeper than wide, or as well wider than deep, depending on the configuration of the base body and the sonic horn. A bottom of the pouch can be wider than the diameter of the shaft, which facilitates decoupling.

It has been shown that a cavity or pouch can cause an acoustic decoupling from the base body. For example, vibration can be absorbed better therewith. The cavity can be provided by means of a bore, for example. The cavity can also comprise multiple pouches or shoulders which succeed one another in a cascade-like manner. As well, the pouch can also comprise steps or shoulders, in particular around the circumference.

In addition, the coupling can be displaced between sonic horn and base body further toward the inside into the base body. As a result, advantages result when attuning. The fastening point of the sonic horn can be displaced inwardly, in particular by means of a relatively long shaft of the sonic horn. As a result, a distance between the sonic horn and the unit for forwarding sound can be influenced.

The coupling means can include a largely free selectable type of connection/fastening, e.g. in the type of a bayonet mechanism, a screwing, a latch mechanism, and/or a fitting.

According to an exemplary embodiment, the fastening point or the coupling means comprise(s) a fitting, in particular a press fitting or a shrink fit. For example, a diameter of an outer shell surface of the sonic horn can be defined with respect to the inner diameter of a bore in the base body. By means of a fitting, the sonic horn can be aligned particularly precisely. A fitting can be provided in addition or as an alternative to a centering.

According to one variant, alternatively or additionally, a pouch can be provided on the sonic horn, in particular in conjunction with a female threaded hole. The respective pouch can, e.g. be provided through a bore. The respective pouch can, e.g. have an inner diameter which is greater than the diameter of a female thread hole by the factor of 1.2 to 3. In view of a possibly thin shaft, it can be advantageous for the pouch to be formed on the base body.

According to one exemplary embodiment, the sonotrode device comprises an electrically contactable unit for forwarding sound, in particular including at least one oscillating element preferably of ceramics, which unit is connected to the base body, wherein the base body comprises fastening means for fastening/coupling the unit for forwarding sound, wherein the fastening means preferably form-fitting or force-fitting. So far, at best, the properties of the sonotrode could be influenced only through attuning of the unit for forwarding sound (e.g. the fastening thereof on the base body). Due to the fact that now the sonic horn is configuring separately, precise attuning or precise tuning can be effected on multiple connecting points or couplings. Here, the sonic horn can be fastened to the base body, and also the unit for forwarding sound can be fastened to the base body, in particular opposite of the sonic horn on an opposite front face side of the base body. Optionally, the unit for forwarding sound and the sonic horn can be in direct contact.

Here, as the unit for forwarding sound, an oscillatory assembly in connection with a frequency generator or amplifier is to be understood which is screwed to the base body, e.g. by means of a screw. The unit for forwarding sound can be structured as "sandwich", i.e. comprise multiple oscillation exciters, e.g. (ceramic) blocks or discs, in particular piezo-ceramics.

The unit for forwarding sound can be fastened to the base body, e.g. by means of a (ceramic) screw. Here, the properties of the sonotrode device can be influenced also through the selection of the material of individual components of the unit for forwarding sound. As oscillating element, preferably a piezo-ceramic is used, in particular in the form of a ceramic block or a ceramic disc.

The fastening means can include a largely freely selectable mechanism, e.g. a bayonet mechanism, a screwing, a latch mechanism, a fitting.

According to an exemplary embodiment, the sonotrode device includes a connection mechanism for connecting the sonic horn and the unit for forwarding sound, wherein the connection mechanism is form-fit and/or force-fit. The connection mechanism allows further measures upon precise tuning. The sonic horn can be brought, e.g. in direct contact to the unit for forwarding sound and/or be braced thereon. The connection mechanism can be provided through the two parts sonic horn and unit for forwarding sound. In particular, an inner end of the sonic horn can be formed geometrically corresponding to an inner end of the unit for forwarding sound. The connection mechanism can operate or be configured independently of the base body. For example, the base body comprises a through-hole in which the connection mechanism can be arranged. Coupling means and fastening means are provided independently of the connection mechanism.

According to an exemplary embodiment, the sonotrode device includes a coupling for fastening the sonic horn on/in the base body and/or on a/the unit for forwarding sound, wherein the coupling is form-fit and/or force-fit. The coupling can be configured for directly connecting the sonic horn with the unit for forwarding sound. By means of the coupling, the sonic horn and the unit for forwarding sound can also be locked against one another. The coupling can optionally comprise two or three coupling locations/coupling points, namely a respective coupling location for the unit for forwarding sound and the sonic horn and a coupling point for positioning the coupling in the base body. The coupling can optionally be anchored in the base body so that the two parts in each case can be mounted directly on the coupling. Coupling means and fastening means are provided on the coupling.

In contrast to a connection mechanism which can also be provided independently of the base body, the coupling is arranged in a predefined coupling point on the base body or provided to be arranged therein. Thus, the coupling allows to couple two parts in only one coupling point to the base body.

According to an advantageous exemplary embodiment, a distance between an inner end of the sonic horn and an inner end of the unit for forwarding sound is pre-definably or attunable. Alternatively, or additionally, the installation depth of the sonic horn in the base body or the installation depth in the sonic horn can be pre-definable or attunable. Alternatively, or additionally, an installation depth of the unit for forwarding sound in the base body can be pre-definable or attunable. As a result, parameters of the sonotrode device in each case can be adjusted in a flexible manner, in particular the natural frequency.

According to an exemplary embodiment, a/the shaft of the sonic horn is guided through a guide-through of a high-pressure resistant housing. According to an exemplary embodiment, a/the shaft of the sonic horn is sealed in a/the guide-through of a high-pressure resistant housing, in particular by means of at least one sealing arranged radially on the shaft and/or at least one high-pressure resistant sealing arranged at the front face. This arrangement broadens the field of use of the device.

ITEM1 At least one of the previously mentioned objects is also achieved through a sonotrode device for providing sound waves for examinations by means of acoustic levitation, with a base body, a sonic horn for emitting sound waves in the direction of a reflector; wherein the sonic horn and the base body are different parts and the sonic horn is mounted in a fastening point in an installation depth on or in the base body, wherein the sonic horn comprises a shaft with coupling means, which is mounted in the installation depth in the fastening point on or in the base body, in particular mounted such that the natural frequency of the sonotrode device is definable by means of or at the fastening point, wherein the sonotrode device comprises a high-pressure resistant housing and is configured for operation at high pressure over 200 bar, in particular up to 1000 bar, wherein the shaft is guided through a guide-through of the housing and is sealed therein, in particular by means of at least one sealing arranged radially on the shaft and/or at least one high-pressure resistant sealing arranged at the front face, and wherein the sonotrode device is configured to provide the sound waves at a low voltage, in particular such that the amplitude of emitted sound waves is kept below 50 Vpp. Numerous of the previously mentioned advantages can be deduced.

ITEM2 At least one of the previously mentioned objects is also achieved through a sonotrode device for providing sound waves for examinations by means of acoustic levitation, with a base body, a sonic horn for emitting sound waves in the direction of a reflector; wherein the sonic horn and the base body are different parts and the sonic horn is mounted in a fastening point in an installation depth on or in the base body, wherein the sonic horn comprises a shaft with coupling means, which is mounted in the installation depth on or in the base body, wherein the fastening point is configured for fastening in a form-fit and/or force-fit manner, wherein the base body or the shaft comprises coupling means including a cavity or pouch for coupling the sonic horn in the fastening point, wherein the installation depth of the sonic horn in the base body or the installation depth in the sonic horn is attunable, in particular attunable such that the natural frequency of the sonotrode device is definable by means of or at the fastening point. Numerous of the previously mentioned advantages result thereof.

At least one of the previously mentioned objects is, as mentioned, also achieved through an apparatus according to the corresponding independent claim, in particular for examining substances by means of acoustic levitation, wherein the apparatus comprises at least one sonotrode device according to the invention and is configured for operation at high pressure up to over 200 bar and/or at low voltage oscillation amplitudes, in particular below 50 Vpp. The apparatus can generally be configured for examining and/or fixing substances, samples or objects, in particular by means of acoustic levitation. The apparatus can be suitable for examinations in the range of overpressure as well as in the range of negative pressure.

At least one of the previously mentioned objects is also achieved through an apparatus with at least one sonotrode for examining substances by means of acoustic levitation, in particular with at least one sonotrode device according to the invention, wherein the apparatus comprises a control device which is configured to control the sonotrode/sonotrode device and/or a frequency generator and/or amplifier of the apparatus optionally manually guided through a user or automated by means of autopilot, in particular depending on pressure measurement values and/or temperature measurement values.

Preferably, the control device is configured to switch between autopilot and manual mode. Preferably, the apparatus comprises a preferably audio-visual input mask, e.g. a touch screen, to that end. For example, the control device is configured to adjust the frequency and/or amplitude or realize a frequency change and/or amplitude change manually predetermined by the user.

According to an exemplary embodiment, the control device of the apparatus is adapted to at least one parameter, in particular the natural frequency of the sonotrode/sonotrode device, in particular in that the control device is adjusted to a/the fastening point or the installation depth, and/or to a/the connection mechanism and/or a/the coupling on the base body of the sonotrode or sonotrode device. In other words: the control device can control the frequency generator or amplifier depending on how/where the sonic horn is fastened on the base body. The control device can adjust the natural frequency, in particular by calculating the natural frequency based on pressure measuring values and/or temperature measuring values. Prior to that, the sonotrode device can be adjusted or finely adjusted in view of certain pressure conditions and/or temperature conditions.

Here, a direct dependency between the sonotrode device and the control device or the software thereof can exist. Based on the attuning of the sonotrode device, a function or dependency can be determined, based on which the natural frequency can be calculated and can be predetermined to the sound-generating components as working or operation frequency.

According to an advantageous exemplary embodiment, the apparatus comprises a gasproof and optionally also (high-)pressure resistant housing, in which the sonotrode device is at least partially arranged, wherein the apparatus preferably comprises a pressure measuring unit and/or a temperature measuring unit, which each detect measuring values within the housing, wherein the respective measuring unit preferably is in communication with a/the control device of the apparatus. This structure allows a precise control of the sonotrode device depending on a plurality of different parameters/measurement values.

According to an advantageous exemplary embodiment, the apparatus is configured to operate the sonotrode device free of cooling energy without active cooling, in particular over a time period of at least multiple hours, for example at least three or five hours. Completely dispensing with coolants or actively introducing cooling power not only has energetic advantages, but also allows high precision of examinations as well as a simple structure, in particular in a high-pressure view cell. The sonotrode device can be operated, in particular by means of the control device based on temperature measurement values, such that the sonotrode device operates without cooling in a thermal equilibrium and a cooling is not required. This not least increases operational safety. Insufficient cooling can thus not result in a discontinuation of an experiment. In other words: the sonotrode device according to the invention is extremely robust, low-maintenance and appropriate also for laborious examinations with high expectations in terms of precision.

At least one of the previously mentioned objects is also achieved, as mentioned, through a method for controlling a sonotrode, in particular a sonotrode device according to the invention, and/or for controlling an apparatus for examining substances by means of acoustic levitation, in particular an apparatus according to the invention according to the corresponding independent claim, wherein the sonotrode/sonotrode device is applied with a frequency depending on the natural frequency thereof, wherein the sonotrode device is operated at high pressure, in particular up to over 200 bar, and/or at low voltage oscillation amplitudes, in particular below 50 Vpp, wherein the frequency is preferably predetermined based on actual temperature values and/or actual pressure values. The temperature values and pressure values can be predetermined for a control device which determines the frequency based on the natural frequency of the sonotrode with which the frequency generator is to apply the sonotrode.

At least one of the previously mentioned objects is also achieved through a control device for controlling a sonotrode, in particular a sonotrode device according to the invention, and/or for controlling an apparatus for examining substances by means of acoustic levitation, in particular an apparatus according to the invention according to the corresponding independent claim, wherein the control device is configured to apply the sonotrode/sonotrode device with a frequency depending on the natural frequency thereof as well as on actual temperature values and/or actual pressure values in the range of the sonotrode/sonotrode device, in particular at high pressure over 200 bar and/or with oscillation amplitudes below 50 Vpp.

Preferably, the control device is in communication with the reflector or another sonotrode device, in particular to control/regulate a distance between reflector and sonic horn. The reflector can be movable to adjust the distance to the sonotrode device and to set the arrangement with respect to the standing wave or the predetermined wave length or to make a type of precise tuning. The intensity of the sonic field is adjustable. In particular, the form of the substance/fluid held floating in the wave field can be changed thereby.

At least one of the previously mentioned objects is also achieved through the use of a sonotrode, in particular a sonotrode device according to the invention, for examining substances by means of acoustic levitation, wherein the sonotrode/sonotrode device has the natural frequency which is defined through the type of fastening and/or through the location of fastening a sonic horn of the sonotrode/sonotrode device on a base body of the sonotrode/sonotrode device.

At least one of the previously mentioned objects is also achieved through the use of a sonotrode, in particular a sonotrode device according to the invention, in an apparatus for examining substances by means of acoustic levitation, wherein the sonotrode/sonotrode device is operated at a low voltage, in particular below 50 Vpp for the voltage magnitude, which describes an amplitude of the generated acoustic wave.

At least one of the previously mentioned objects is also achieved through the use of a sonotrode, in particular a sonotrode device according to the invention, in an apparatus for examining substances by means of acoustic levitation, wherein a shaft of a sonic horn of the sonotrode/sonotrode device is coupled to a base body of the sonotrode/sonotrode device with a predefined torque in a pouch in a predefinable installation depth. This allows influencing the natural frequency of the sonotrode.

At least one of the previously mentioned objects is also achieved through the use of a sonotrode, in particular a sonotrode device according to the invention, in an apparatus for examining substances by means of acoustic levitation, wherein a sonic horn of the sonotrode/sonotrode device, in particular a shaft of the sonic horn is guided through a wall of the apparatus and arranged separately from a base body of the sonotrode/sonotrode device and is sealed or soundproof with reference to the base body, and wherein the sonotrode device (10) is operated at high pressure over 200 bar and/or with oscillation amplitudes below 50 Vpp.

At least one of the previously mentioned objects is also achieved through the use of a sonotrode, in particular a sonotrode device according to the invention, in an apparatus for examining substances by means of acoustic levitation, wherein the sonotrode/sonotrode device is controlled by a control device depending on the natural frequency thereof.

At least one of the previously mentioned objects is also achieved through the use of a control device for controlling a sonotrode, in particular a sonotrode device according to the invention, wherein the control device is adapted individually to at least one parameter of the sonotrode/sonotrode device, in particular to the natural frequency thereof.

At least one of the previously mentioned objects is also achieved through a method for producing or providing a sonotrode, in particular a sonotrode device according to the invention, according to the corresponding independent claim, wherein a shaft of a sonic horn is fastened in a pouch in a predefined installation depth or in the shaft on a base body of the sonotrode/sonotrode device, wherein the natural frequency of the sonotrode/sonotrode device is adjusted or defined through the fastening. The sonic horn is preferably fastened separately on the base body independent of further components of the sonotrode. The sonic horn can, e.g. be screwed manually or automated to the base body with a predetermined torque. Optionally, the sonic horn can be fastened, in particular braced, on the base body together with a unit for forwarding sound.

At least one of the previously mentioned objects is, as mentioned, also achieved through a mounting kit for a sonotrode, in particular for a sonotrode device according to the invention, according to the corresponding independent claim, wherein the mounting kit includes at least one sonic horn as a separate part, wherein a base body of the sonotrode/sonotrode device comprises coupling means, which are formed corresponding to coupling means on a shaft of the sonic horn and in/on which the sonic horn is mountable in a definable installation depth, in particular in a pouch. Providing the sonotrode device with a separate sonic horn in particular allows a precise attuning in a simple manner.

At least one of the previously mentioned objects is also achieved through a sonotrode, in particular a sonotrode device according to the invention, obtained through mounting/fastening a shaft of a sonic horn provided separately from a base body of the sonotrode/sonotrode device in a fastening point in a predefined installation depth on or in the base body, wherein preferably the natural frequency of the sonotrode/sonotrode device is defined through the mounting/fastening. The horn can be arranged separately from the base body and insulated therefrom or sealed separate in an examination chamber.

Summary: Sonotrodes are used in the examination of substances based on acoustic levitation. To obtain a reproducible measurement result or to broaden the field of use of such apparatuses, the respective sonotrode must satisfy a series of requirements. The precise calibration of the frequency and a precise interplay between the sonotrode and the frequency generator are particularly important. The present invention proposes that a sonic horn and a base body of the sonotrode are provided as different parts and that the sonic horn here is mountable on or in the base body in a specific manner, in particular for low voltage operation such that the amplitude is kept below 50 Vpp. Here, heat generation can be avoided by selecting the structure of the sonotrode so that the operational voltage is at a relatively low maximum low voltage value, e.g. 50 Vpp max. Furthermore, the present invention relates to a control or production method for such a sonotrode device. Here, it is possible in each case to broaden the field of use and to improve the reproducibility or quality of the measurement results.

BRIEF DESCRIPTION OF THE SEVERAL VIEWS OF THE DRAWINGS

The invention will be described in more detail in the following figures of the drawings, wherein reference is made to the other figures of the drawings for reference characters that are not explicitly described in one respective figure of the drawings. The figures show in.

DETAILED DESCRIPTION OF THE FIGURES

Figure 1:
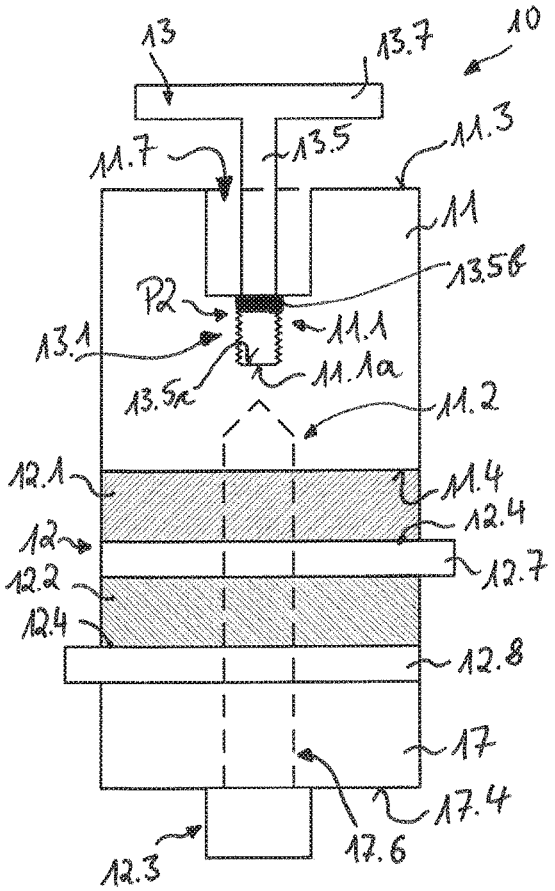
FIG. 1 in a partially sectional side view in a schematic illustration, a sonotrode/sonotrode device according to an exemplary embodiment of the invention.

In FIG. 1, a sonotrode device 10 with a base body 11, in particular a first end mass, with a (second) end mass 17, a unit for forwarding sound 12 with a first electrode 12.7 and a second electrode 12.8 and with a sonic horn 13 is illustrated. The horn 13 preferably consists of metal. The two electrodes contact in each case an oscillating element 12.1, 12.2, in particular a piezo-ceramic. The respective electric contacting 12.4 can be effected on front faces. The number of electrodes or oscillating elements can vary. Fastening means 12.3, in particular a screw with male thread, fix these components on the base body 11 in the type of a sandwich. The fastening means 12.3 can clamp or brace the five components 12.1, 12.2, 12.7, 12.8. 17 arranged in a row to the base body 11.

Figure 3:
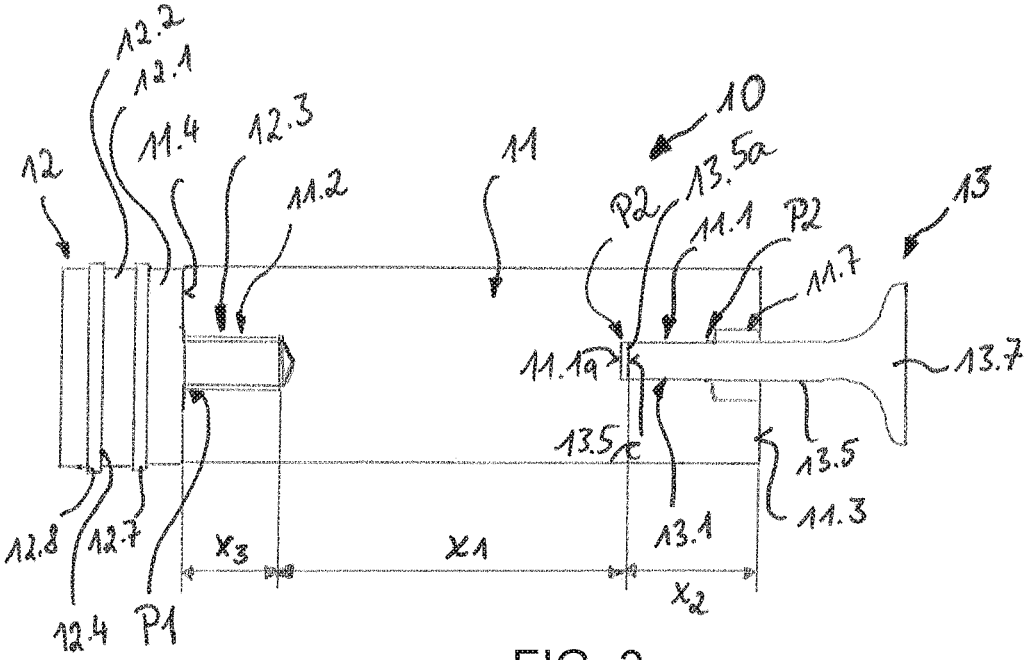
FIG. 3 in a partially sectional side view in a schematic illustration, a sonotrode/sonotrode device according to a further exemplary embodiment of the invention.

In FIG. 1, the sonotrode device 10 is illustrated aligned in the vertical direction. During operation, the sonotrode device 10 can also be aligned in horizontal direction rotated by 90° (FIG. 3).

The base body 11 comprises at least one coupling means or coupling element 11.1 for the sonic horn. In the illustrated example, the coupling means includes a female thread. Furthermore, the base body 11 comprises, on a first front face, a cavity or pouch 11.7, on which the coupling means 11.1 are formed or from which the coupling means 11.1 extend in the direction of the unit for forwarding sound 12, in particular in parallel to the fastening means 12.3 or along the same geometric axis. The pouch 11.7 has, e.g. a positive effect on the heat generation of the sonotrode device.

The sonic horn 13 comprises corresponding coupling means 13.1, in particular including a male thread which is provided on a shaft 13.5, in particular at the end of the shaft. The coupling means 13.1 can include a centering 13.5*b*, in particular a fitting in addition to a screw connection. The position of the centering 13.5*b* can deviate from the arrangement shown, in particular if also the installation depths or the location, at which structure-borne sound is transferred from the base body to the sonic horn, is influenced by means of the centering. Such a centering may only be indicated in FIG. 1, can also be provided in the sonic horns according to the further exemplary embodiments. A centering arranged at an outer edge of the pouch 11.7 allows a particularly precise alignment of the shaft 13.5. On a free end, the sonic horn 13 comprises a plate 13.7. Sound waves can be emitted and reflected from the plate 13.7.

Opposite of the sonic horn 13, the base body 11 comprises fastening means 11.2 for the unit for forwarding sound, in particular including a female thread. The fastening means 11.2 are arranged preferably along the same geometrical axis as the coupling means 11.1 or at least in parallel thereto. The shaft is mounted in the base body with an installation depth x2 (FIGS. 3, 5) in the fastening point P2.

The first oscillating element 12.1 abuts on a second front face 11.4 of the base body 11. The fastening means 12.3 abuts on a front face 17.4 of the second end mass 17. The second end mass 17 comprises a through-hole 17.6, through which the fastening means 12.3 is guided. According to a variant, a female thread corresponding with the fastening means 12.3 is only formed on the base body 11.

The separate sonic horn 13 now can be fastened on the base body 11 in different ways, in particular without having to change the fastening of the unit for forwarding sound. As a result, in each case particularly suitable form-fit and/or force-fit coupling means 11.1 can also be specifically formed. For example, the distance between the plate 13.7 and the front face 11.3 is adjustable.

Figure 2:
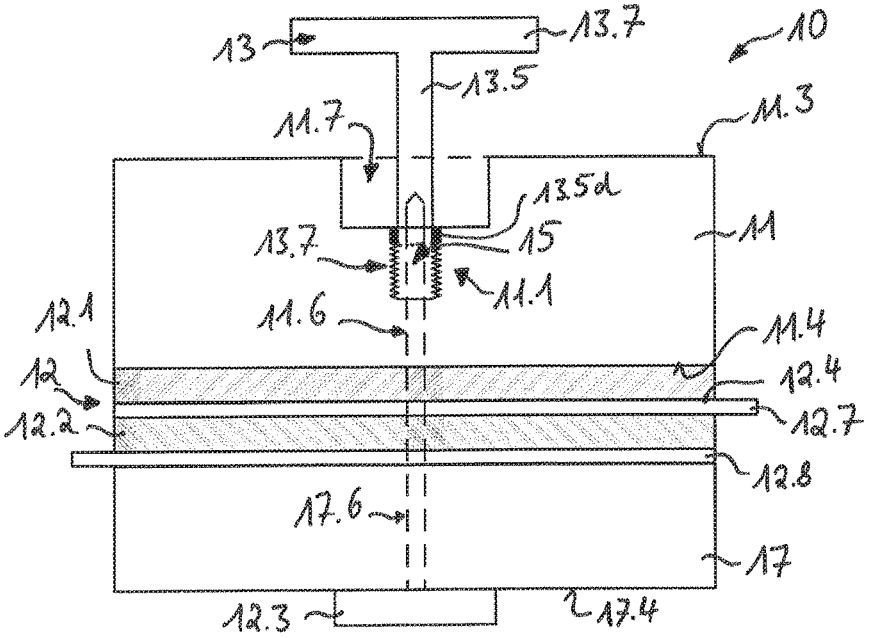
FIG. 2 in a partially sectional side view in a schematic illustration, a sonotrode/sonotrode device according to a further exemplary embodiment of the invention.

In FIG. 2, a variant is shown, in which the horn 13 is also directly connected to the fastening means 12.3. As a result, the base body 11 comprises a through-hole 11.6 through which fastening means 12.3 are guided. A connecting mechanism 15 for connecting the horn 13 with the unit for forwarding sound 12 or with the fastening means 12.3 ensures that these components can be directly coupled to one another in terms of oscillation. The fastening means 12.3 can brace the five components 12.1, 12.2, 12.7, 12.8, 17 arranged in a row to the base body 11 and thereby also brace the horn 13 to the base body 11 or the unit for forwarding sound 12. The connecting mechanism 15 can, e.g. include a female thread hole in the shaft 13.5 which is formed corresponding to a male thread of the fastening means 12.3. Here, the fastening means 12.3 does not necessarily need to directly interact with the base body 11.

With the example of FIG. 2, also a fitting 13.5*d* is shown, which is formed on a section of the shaft 13.5. The position indicated can also vary. Such a fitting may only be indicated in FIG. 2, can also be provided in the sonic horns according to the further exemplary embodiments.

In FIG. 3, a variant is shown in which a/the sonic horn 13 is fastened on the base body 11 in one fastening point P2 or at least one mounting point, wherein the position of the sonic horn 13 can be adjusted, for example through a predefined tightening torque. The shaft 13.5 can form a fitting together with the coupling means 11.1, at least in sections. The coupling means 11.1 can ensure a fitting or are configured, e.g. for a press-fitting. An inner end 13.5*a* of the sonic horn is arranged in a mounting depth/installation depth x2, in particular measured form the corresponding front face 11.3 to the inner end 13.5*a*. The installation depth x2 can be defined independent of dimensions of the pouch. According to a variant, the installation depth x2 can correspond to the depth of the pouch 11.7. In the arrangement shown in FIG. 3, the sonic horn can also be moved further into the base body until corresponding contact surfaces 11.1*a*, 13.5*a* on the front face side abut. The inner end of the sonic horn is arranged at a distance x1 from an inner end of the unit for forwarding sound 12 or the fastening means 12.3. The installation depth x2 and thereby also optionally the distance x1 can be varied, in particular manually. The unit for forwarding sound 12 is fastened on the base body 11 in a fastening point P1 or a mounting point. An inner end of the unit for forwarding sound 12 or of the fastening means 12.3 is arranged in a mounting depth/installation depth x3, in particular measured from the corresponding front face 11.4.

The variant shown in FIG. 3 can be combined with the features of the variants shown in FIGS. 1 and 2. In particular, optionally also a connecting mechanism 15 or a coupling can be provided.

Figure 4:
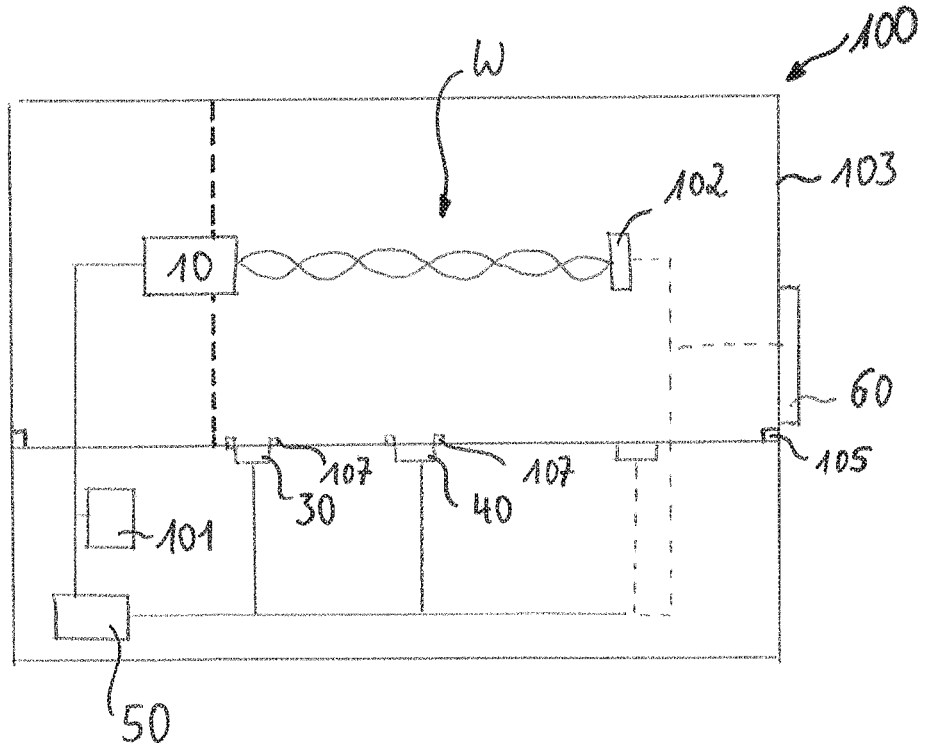
FIG. 4 in a schematic illustration, an apparatus for examining substances by means of acoustic levitation according to an exemplary embodiment of the invention.

FIG. 4 shows an apparatus 100 for examining substances by means of acoustic levitation which includes a frequency generator 101, a reflector 102, a preferably high-pressure resistant and/or thermally insulated housing 103, a/the sonotrode device 10 as well as at least one temperature measuring unit 30 and at least one pressure measuring unit 40 and further a control device 50 connected therewith. Within the housing 103, a wave field W is generated between the sonotrode device 10 and the reflector 102. Here, the control device 50 can communicate with the measuring units 30, 40 of the sonotrode device 10, the reflector 102 and/or the frequency generator 101. An operating panel 60 with an optical or opto-acoustic input mask or display/touchscreen is arranged accessible for a user on an outer surface of the apparatus 100.

Furthermore, first and second sealings or sealing systems 105, 107 are indicated. The sealings allow a high-pressure compatible structure. The sealings can be configured, e.g. for a pressure difference in the range of 200 bar or 1000 bar. Here, the sealings can cause also a sound insulation of individual components in each case relative to one another. A first sealing system 105 here can relate, e.g. to the sealing of individual components in the sonotrode device 10 or the housing 103, and a second sealing system 107 can relate, e.g. to the sealing of individual measuring units 30, 40. Each sealing system can include one or multiple O rings. Here, sealings in the form of O rings can fulfil a soundproofing function. The arrangement of the sealings/sealing systems is indicated only in an exemplary manner and can deviate therefrom. For example, sealings can also be provided directly at the sonotrode device 10.

Figure 5:
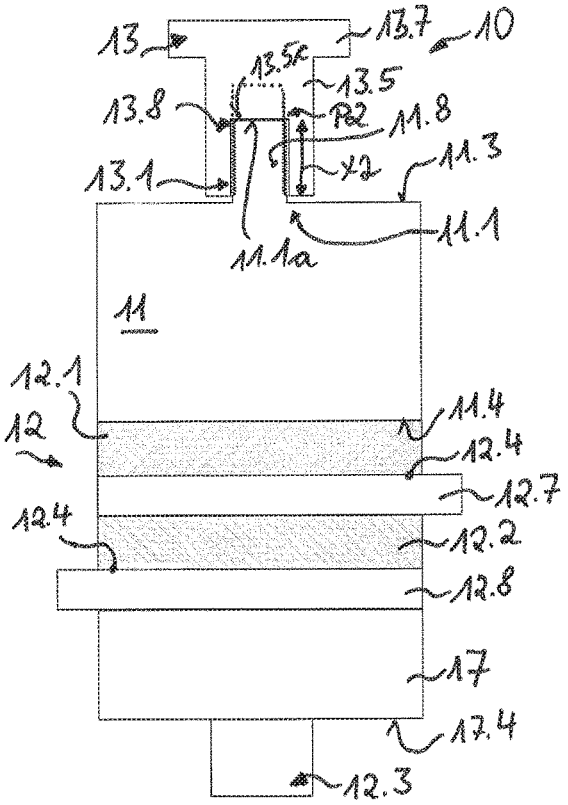
FIG. 5 in a partially sectional side view in a schematic illustration, a sonotrode/sonotrode device according to a further exemplary embodiment of the invention.

In FIG. 5, a sonotrode device 10 with a base body 11 is shown which comprises a plug 11.8 on a front face side 11.3 (not shown) directed to the reflector. The plug 11.8 can be a constituent of coupling means 11.1 or provide these. The coupling means 11.1 in this case include a male thread which is formed on the plug 11.8. The sonic horn 13 comprises a cavity 13.8 formed geometrically corresponding to the plug 11.8. Coupling means 13.1 of the sonic horn 13 are formed in this cavity 13.8 and include a female thread. Optionally, alternative types of form-fit and/or force-fit coupling can be provided deviating from the thread. Optionally, a pouch can also be provided on the sonic horn, which, e.g. has an inner diameter which is greater than the diameter of the cavity 13.8 by the factor of 1.2 to 2. Cavity and pouch then can merge into one another at a shoulder. As also indicated in FIG. 6C, the fastening can be effected, e.g. exclusively on a bottom of the cavity 13.8. The shaft is mounted on the base body in the installation depth x2 in a fastening point P2.

Figure 6A:
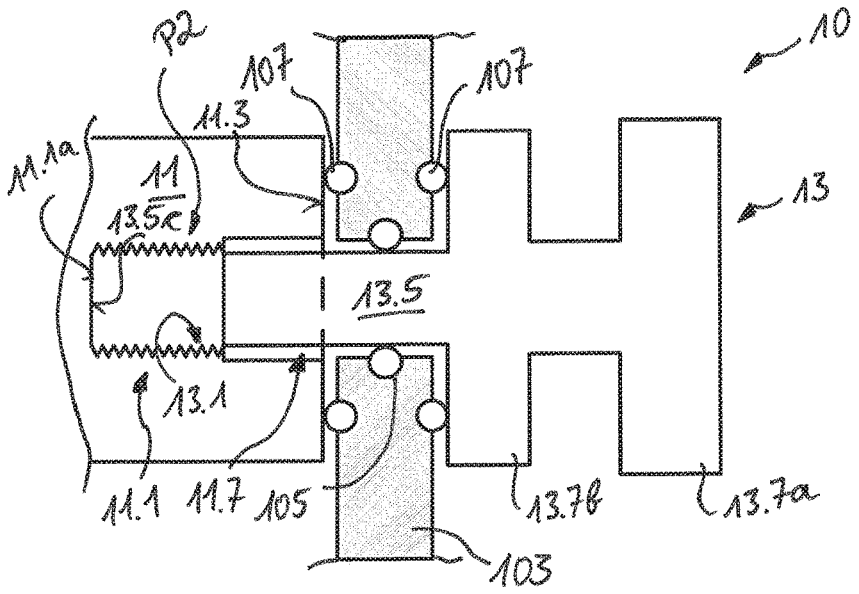
FIGS. 6A, 6B, 6C in each case in a sectional side view in a schematic illustration, a sonotrode/sonotrode device according to one of the exemplary embodiments of the invention in each case mounted on a housing or a high-pressure view cell.
Figure 6B:
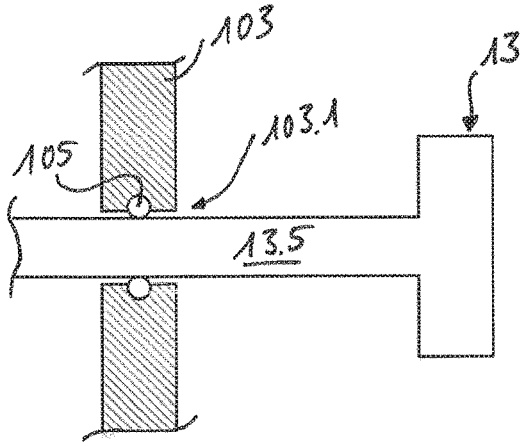
Figure 6C:
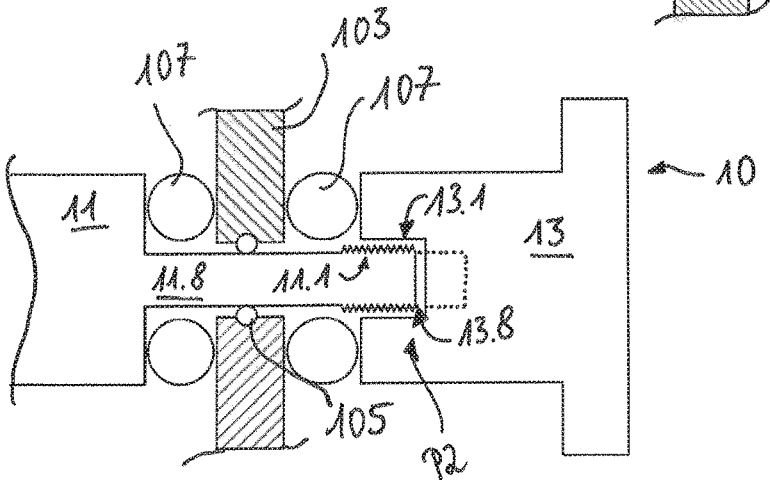

In the FIGS. 6*a*, 6B and 6*c*, some optional variants for the mounting of the sonotrode device according to the invention are indicated. As the sonic horn 13 is designed separately from the base body 11, the mounting can be effected in a particularly flexible manner. For example, the sonic horn 13 can be clamped or tightened with the base body 11 on a housing wall 103, e.g. on a wall of a high-pressure view cell (FIGS. 6A, 6C). Optionally, the shaft 13.5 can also be guided through the wall 103 without being braced (FIG. 6B).

In detail, FIG. 6A shows a sonic horn 13 with a front plate 13.7*a* and a rear plate or shoulder 13.7*b*, wherein the rear plate 13.7*b* can be pressed/braced to the outer surface of the housing 103 in the type of a shoulder. As well, the front face 11.3 of the base body 11 can be braced to an inner surface of the housing 103. The base body 11 here can be arranged outside of an examination chamber. Between the sonotrode device 10 and the wall 103, two types of sealings 105, 107 are provided, wherein both types can be designed as O ring sealing. On the shaft 13.5, a sealing 105 is arranged which can center the shaft 13.5 in the hole of the wall 103 (in particular optionally also additionally to a centering provided in the fastening point P2) and can acoustically decouple the horn 13 from the wall 103. On the front face sides, in each case a sealing 107 is provided which can withstand a relatively great bracing/pressing force. Here, the sonotrode device 10 can be arranged in a predefined angle relative to the wall 103 and thereby be aligned. The respective sealing can be arranged, e.g. on a shoulder not shown in detail or in a groove. An acoustic decoupling can be caused by means of this sealing system 107. The front face side 11.3 and the side of the rear plate 13.7*b* directing to the base body 11 here can be aligned in parallel to one another which allows a mounting of the horn 13 in different rotational positions.

The sonic horn 13 shown in FIG. 6B is guided through a guide-through 103.1 in which an O ring sealing 105 retained in a groove is arranged. Further sealings are not necessarily required. The sealing 105 abuts on the shaft 13.5, wherein the shaft 13.5 comprises, e.g. a shoulder, a groove and/or a corresponding sealing surface for arranging the sealing 105. The base body not illustrated in detail needs not be fastened to the wall 103 but can be fastened to another part of the housing. The arrangement shown in FIG. 6B allows a particularly well acoustic decoupling of the horn 13 from the housing, even if the horn needs to be arranged in, e.g. a high-pressure view cell. The sealing or acoustic decoupling can be effected by means of a single sealing. This allows not least a mounting/attuning in a simple or flexible manner.

FIG. 6C shows a sonotrode device 10 mounted braced with a plug 11.8, for example according to the exemplary embodiment shown in FIG. 5. The plug 11.8 thus can be significantly longer than the corresponding cavity or pouch 13.8, wherein the coupling means 11.1 are provided preferably only in front region of the plug. In a middle or rear region of the plug, e.g. a shoulder, a groove and/or a corresponding sealing surface for arranging the sealing 105 is provided. In other words: the plug 11.8 is configured to ensure a coupling function as well as a sealing function. The sealings 107 abutting on the front face side can have greater dimensions, in particular a greater diameter than the sealing 105, in particular for receiving pressing/bracing forces and/or for setting a sealing effect in manner as precise as possible.

Figure 7:
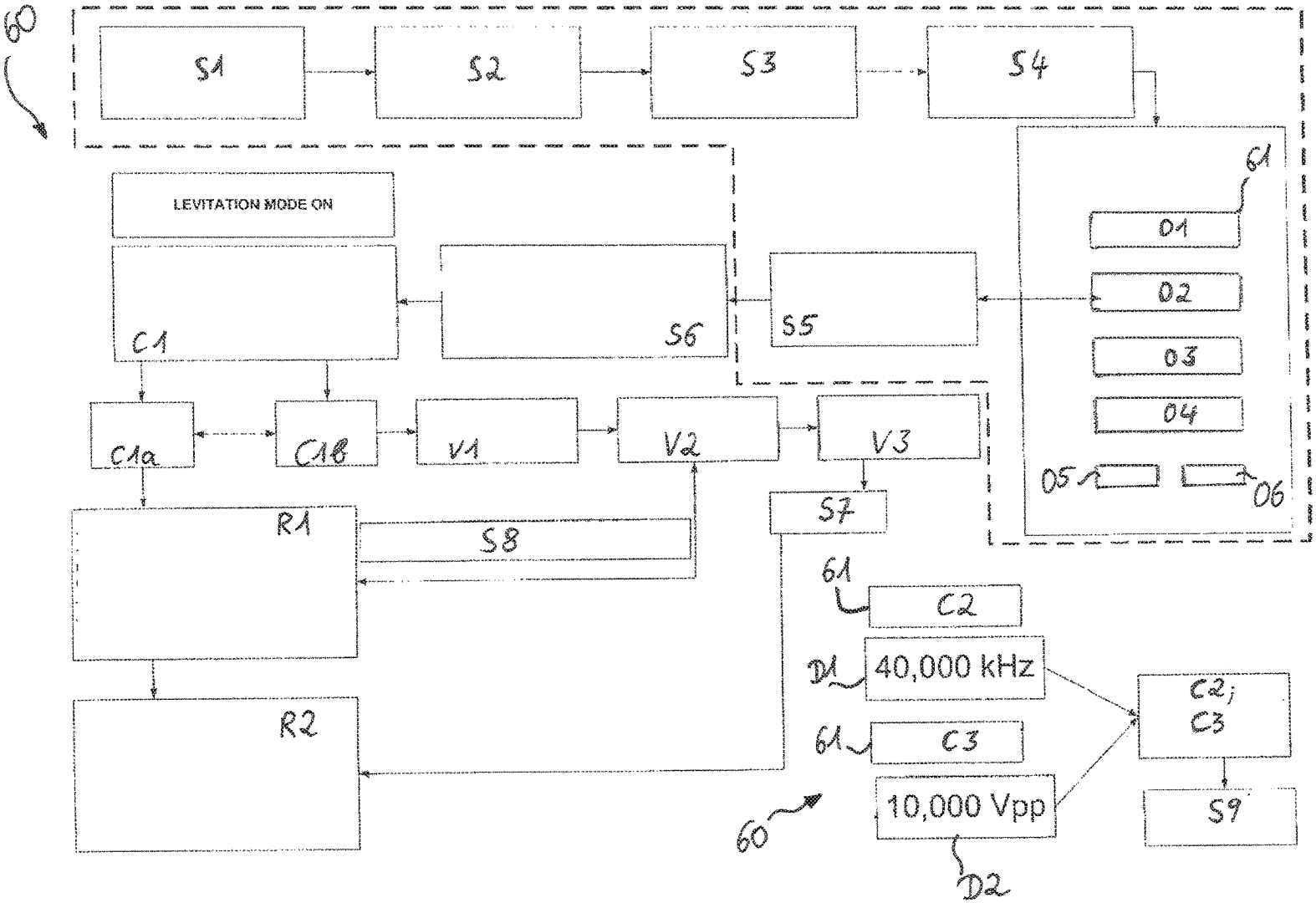
FIG. 7 in a schematic form, an overview concerning a user guidance or control steps or setting steps of an apparatus or of a control device according to an exemplary embodiment of the invention.

FIG. 7 shows a flow chart for an exemplary menu navigation in controlling a sonotrode according to the invention. Individual steps of a starting process of an apparatus according to the invention for examinations by means of acoustic levitation are indicated through a dashed line as starting method including steps S1 to S4. In step S1, a user switches the apparatus on. In step S2, the apparatus takes on the standby mode. In step S3, a PC is switched on. In step S4, an examination software is started.

After switching on the apparatus, a menu exemplary described here, e.g. including the following options O1 to O6 is displayed to the user: O1 VIDEO UPLOAD, O2 LIVE METERING, O3 TUTORIAL, O4 SETTINGS, O5 QUIT, O6 ABOUT. Starting from this input mask, different user instructions can be made. Here, also an operation with respect to the examination and measurement of physical substance data can be effected, in particular via one or multiple menu item(s).

The user then can start, e.g. a measurement (LIVE METERING) (step S5) and thereby select (step S6) whether the control is to be effected automatically in the autopilot mode (selection item C1*a*) or manually (selection item C1*b*), in particular also during operation (selection item C1). The selection items C2, C3 can also be buttons or touch surfaces 61, on which the frequency (C2) and the amplitude (C3) is adjustable, which also in each case is displayed (D1, D2), and which automatically can be adopted (step 9) by a control device in response to an input. Here, a working operation frequency is set, in particular depending on pressure or temperature values which can be measured, e.g. by means of respective measurement units/sensors in a housing, even in a continuous manner. In particular, the signal shape (V1), in particular rectangle, and the basic frequency (V2), e.g. 40 kHz, and the basic amplitude (V3), e.g. 10 Vpp is adjustable. Here, the frequency can be automatically adopted by the activated autopilot (step S8). After setting these parameters, the wave field can be generated and a sample can be examined (step 7; "channel on"). The placeholders R1, R2 stand for a sum of operation state data for a certain environment, in particular for rectangular signal shape and frequency determination from an expression considering pressure and temperature, as well as a basic amplitude of, e.g. 10 Vpp (R1), or for amplifier properties like the impedance, e.g. 50 Ohm and alternating voltage (R2).

The user can optionally work with video sequences (VIDEO UPLOAD). The user can optionally load or display technical information or instruction manuals (TUTORIAL). The user can optionally make settings to the software of the control device or to the apparatus (SETTINGS). As a result, also an adjustment or a precise tuning can be made, in particular by adjusting parameters like the natural frequency of the sonotrode device by the control device. The user can optionally exit the input mask (QUIT), in particular to turn the apparatus off, or can have contact information or access data or program or apparatus versions (ABOUT) displayed.

The input program only roughly described here or the control device operable therewith facilitates the manual or automated execution of measurements and records for measurement results as well as the diagnose or remote maintenance of the apparatus. Examinations can be executed on highly-standardized or professional level, in particular reproducible for third parties. FIG. 7 also shows that the levitation measurement can be executed with a comparatively very low basic amplitude in the range of 10 Vpp, which is advantageous in particular with respect to high-pressure applications.

LIST OF REFERENCE CHARACTERS

10 Sonotrode device
11 Base body, in particular (first) end mass
11.1 Coupling means or coupling element for sonic horn
**11.1*a*** Contact surface geometrically corresponding to contact surface on shaft
11.2 Fastening means for unit for forwarding sound, in particular thread
11.3 First front face, in particular directed to the reflector
11.4 Second front face, in particular directed to the unit for forwarding sound
11.6 Through-hole
11.7 Cavity or pouch
11.8 Plug
12 Unit for forwarding sound/sound emission
12.1 Oscillating element/oscillation exciter, in particular (first) piezo-ceramic
12.2 Oscillating element/oscillation exciter, in particular (second) piezo-ceramic
12.3 Fastening means, in particular screw
12.4 Electrical contacting
12.7 (first) electrode
12.8 (second) electrode
13 Sonic horn
13.1 Coupling means or coupling element
13.5 Shaft
**13.5*a*** Inner end
**13.5*b*** Centering
**13.5*c*** Front face with contact surface geometrically corresponding to contact surface of the coupling means
**13.5*d*** Fitting
13.7 Plate
**13.7*a*** front plate
**13.7*b*** rear plate

13.8 Cavity or pouch
15 Connecting mechanism for connection of unit for forwarding sound with sonic horn
17 (second) end mass
17.4 Front face
17.6 Through-hole
30 Temperature measuring unit
40 Pressure measuring unit
50 Control device
60 Operation panel with optical or opto-acoustical input mask or display/touch screen
61 Touch surface
100 Apparatus for examining and/or fixing of substances, samples or objects, in particular by means of acoustic levitation
101 Frequency generator
102 Reflector
103 Housing, preferably high-pressure resistant and/or thermally insulated
103.1 Guide-through, opening, access
105 First sealing or first sealing system
107 Second sealing or second sealing system
C1, C1*a*, C1*b*, C2, C3 Selection items or decision options for a user
D1, D2 Display with displayed parameter
O1, O2, O3, O4, O5, O6 Options for a user
P1 Fastening point/mounting point for unit for forwarding sound
P2 Fastening point/mounting point for sonic horn
R1, R2 Place holder for operation state data and optionally also display
S1, S2, S3, S4, S5, S6, S7, S8, S9 Steps during operation of the apparatus
V1, V2, V3 Variables or attunable parameters
W Wave field
x1 Distance between inner end of the sonic horn and inner end of the unit for forwarding sound
x2 Installation depth of the sonic horn, in particular measured form the corresponding front face side
x3 Installation depth of the unit for forwarding sound, in particular measured from the corresponding front face side

The invention claimed is:

1. A sonotrode device for providing sonic waves for examinations by means of acoustic levitation, comprising:
- a base body; and
- a sonic horn for emitting sonic waves in the direction of a reflector;
- wherein the sonic horn and the base body are different parts;
- wherein the sonic horn is mountable in a fastening point at an installation depth on or in the base body;
- wherein the sonic horn comprises a shaft with coupling mountable at the installation depth in the fastening point in the base body;
- wherein the base body comprises coupling including a cavity or pouch for coupling the sonic horn in the fastening point; and
- wherein a hollow space surrounding the shaft is formed between an outer shall of the shaft and a wall of the cavity or pouch.

2. The sonotrode device according to claim 1, wherein the sonic horn comprises a shaft with coupling means, which is mountable at the installation depth in the fastening point on or in the base body.

3. The sonotrode device according to claim 1, at least wherein the sonotrode device comprises a high pressure resistant housing and is configured for operation at high pressure above 200 bar or wherein the sonotrode device is configured for providing the sonic waves at low voltage or wherein the sonotrode device comprises a low voltage source.

4. The sonotrode device according to claim 1, wherein the fastening point is configured for fastening in at least a form-fit or force-fit manner, wherein the fastening point preferably also comprises at least a fitting or a centering.

5. The sonotrode device according to claim 1, wherein the base body comprises coupling means including a cavity or pouch for coupling the sonic horn in the fastening point.

6. The sonotrode device according to claim 1, wherein a distance between the inner end of the sonic horn and an inner end of a/the unit for forwarding sound is adjustable, or wherein the installation depth of the sonic horn in the base body or the installation depth in the sonic horn is adjustable, or wherein an installation depth of a/the unit for forwarding sound in the base body is adjustable.

7. The sonotrode device according to claim 1, wherein a/the shaft of the sonic horn is guided through a guide-through of a high pressure resistant housing, or wherein a/the shaft of the sonic horn is sealed in a/the guide-through of a high pressure resistant housing.

8. The apparatus for examining substances by means of acoustic levitation, wherein the apparatus comprises at least one sonotrode device according to claim 1 and is configured for operation at least at high pressure up to 200 bar or at low voltage oscillation amplitudes, wherein the apparatus comprises a control device which is configured to control the sonotrode device or a frequency generator or amplifier of the apparatus depending on pressure measurement values or temperature measurement values, wherein the control device is adapted to at least one parameter by adjusting the control device to the fastening point or the installation depth, to a/the connection mechanism or to a/the coupling on the base body of the sonotrode device.

9. The apparatus according to claim 8, at least wherein the apparatus comprises a gas-proof and optionally high pressure resistant housing, in which the sonotrode device is at least partially arranged, or wherein the apparatus is configured to operate the sonotrode device free of cooling energy without active cooling.

10. A method for controlling a sonotrode device according to claim 1 or for controlling an apparatus for examining substances by means of acoustic levitation, wherein the sonotrode device is applied with a frequency depending on the natural frequency thereof, wherein the sonotrode device is operated at least at high pressure or low voltage oscillation amplitudes.

11. The method for examining substances by means of acoustic levitation by using the sonotrode device of claim 1, wherein the sonotrode device is operated at a low voltage, which describes an amplitude of the generated acoustic wave.

12. The method for examining substances by means of acoustic levitation by using the sonotrode device of claim 1 in an apparatus, wherein a sonic horn of the sonotrode device is guided through a wall of the apparatus and is arranged separately from the base body of the sonotrode device in an examination chamber and is soundproof relative to the base body, and wherein the sonotrode device is operated at least at high pressure over 200 bar or at oscillation amplitudes below 50 Vpp.

13. The method for examining substances by means of acoustic levitation by using the sonotrode of claim 1, wherein the sonotrode device is controlled by a control device depending on the natural frequency thereof, wherein the control device is individually adapted to at least one parameter of the sonotrode device including the natural frequency thereof.

14. A mounting kit for a sonotrode according to claim 1 wherein the mounting kit comprises at least one sonic horn as discrete part, wherein a base body of the sonotrode/sonotrode device comprises coupling means which are formed corresponding to coupling means on a shaft of the sonic horn and on which the sonic horn is mountable in a definable installation depth.

15. The sonotrode according to claim 1 obtained by mounting a shaft of a sonic horn provided separately from the base body of the sonotrode/sonotrode device in a fastening point in a predefined installation depth on or in the base body, wherein the natural frequency of the sonotrode/sonotrode device is defined through the mounting.

16. The sonotrode device according to claim 3, wherein the sonotrode device is configured for providing the sonic waves at low voltage, wherein the amplitude of emitted sonic waves is kept below 50 Vpp.

17. A method for examining substances by means of acoustic levitation by using the sonotrode device of claim 1 in an apparatus for examining substances by means of acoustic levitation, wherein the sonotrode device is operated at below 50 Vpp for the voltage magnitude.

* * * * *